US009446818B2

(12) United States Patent
Dougherty et al.

(10) Patent No.: US 9,446,818 B2
(45) Date of Patent: Sep. 20, 2016

(54) SECONDARY NAVIGATION STATION

(71) Applicant: R.J. Dougherty Associates, Inc., Edgewater, FL (US)

(72) Inventors: Stephen Dougherty, New Smyrna Beach, FL (US); Joseph Baker Flota, New Smyrna Beach, FL (US)

(73) Assignee: R. J. Dougherty Associates, Inc.

( * ) Notice: Subject to any disclaimer, the term of this patent is extended or adjusted under 35 U.S.C. 154(b) by 310 days.

(21) Appl. No.: 14/065,274

(22) Filed: Oct. 28, 2013

(65) Prior Publication Data

US 2014/0116319 A1 May 1, 2014

Related U.S. Application Data

(60) Provisional application No. 61/719,131, filed on Oct. 26, 2012.

(51) Int. Cl.

*B63B 17/00* (2006.01)
*B63B 15/00* (2006.01)
*B63B 49/00* (2006.01)

(52) U.S. Cl.

CPC ..... *B63B 17/00* (2013.01); *B63B 15/00* (2013.01); *B63B 49/00* (2013.01)

(58) Field of Classification Search

CPC ..... B63B 17/00; B63B 2017/0045; B63B 17/02; B63B 17/23; B63B 2017/026; B63B 19/00; B63B 19/12; B63B 19/14; B63B 19/18; B63B 2019/185; B63B 49/00; B63B 15/00

USPC ..... 114/255, 343, 361, 363, 364

See application file for complete search history.

(56) References Cited

U.S. PATENT DOCUMENTS 3,736,897 A * 6/1973 Krutz ..... B63B 29/04 114/363
3,745,957 A * 7/1973 Hendrickson ..... B63B 19/18 114/202
3,815,541 A * 6/1974 Hansen ..... B63B 25/006 114/246
3,958,524 A * 5/1976 Cantley ..... B63H 21/22 114/146
4,064,584 A * 12/1977 Funkhouser ..... B63B 29/02 114/343

(Continued)

FOREIGN PATENT DOCUMENTS

JP 55087678 A * 7/1980
JP 06255576 A * 9/1994

*Primary Examiner* — Ajay Vasudeva
(74) *Attorney, Agent, or Firm* — Livingston Loeffler, P.A.; Edward M. Livingston, Esq; Bryan L. Loeffler, Esq

(57) ABSTRACT

In accordance with one embodiment of the present invention, the improved secondary navigation station of the invention comprises a horizontal surface which is suspended above the watercraft by a structural system usually comprised of aluminum tubing or equivalent, which horizontal surface may further comprise a navigation station, a seat structure, and a horizontally sliding cover, which, when it is closed position, operates in concert with said horizontal surface to create a solid weatherproof surface, but when open, allows the user or operator of the watercraft to mount a series of steps such that the user or operator of the watercraft is able to navigate the craft from an elevated position from a standing, leaning, or sitting position. The invention allows for an elevated navigation station and elevated positioning for sighting use for fishing and navigation while maintaining a low center of gravity of the watercraft.

12 Claims, 16 Drawing Sheets

(56) References Cited

U.S. PATENT DOCUMENTS 4,425,861 A * 1/1984 Raikamo ..... B63B 29/02 114/202
4,685,411 A * 8/1987 Wick ..... B63B 19/02 114/202
4,729,334 A * 3/1988 DeJean, Jr. ..... B63B 35/14 114/255
6,357,379 B1 * 3/2002 Murphy, Jr. ..... B63B 17/02 114/361
6,568,342 B2 * 5/2003 Mielke ..... B63B 19/18 114/202
6,988,461 B1 * 1/2006 James ..... B63B 15/00 114/364
7,108,570 B2 * 9/2006 Okuyama ..... B63B 49/00 440/84
8,281,732 B1 10/2012 Irvine

* cited by examiner

SECONDARY NAVIGATION STATION

CROSS REFERENCE TO RELATED APPLICATIONS

This U.S. non-provisional patent application claims the benefit of U.S. provisional patent application Ser. No. 61/719,131, filed in the United States Patent and Trademark Office on Oct. 26, 2013 titled IMPROVED SECONDARY NAVIGATION STATION FOR YACHTS, which is incorporated herein in its entirety by reference.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention relates to the field of control and navigation stations for watercraft such as yachts: specifically, the invention is directed to secondary navigation stations for boats such as, for instance, a center console vessel or other type of vessel such as a fishing vessel. The present invention is a novel combination of navigation station and covering for the console of the boat which allows a user to sit at an elevated position or stand at an elevated position while allowing the user to operate the vessel, which may typically be a fishing boat. The present invention represents an improvement in the state-of-the-art of secondary navigation stations because it allows smaller boats to incorporate a secondary navigation station which is elevated above the deck of the boat, thereby providing the advantages of a tower to those smaller vessels which heretofore may have been considered too small to incorporate an elevated tower for navigation and/or fishing use due to safety and stability concerns.

2. Background Art

It is well known in the art that fishing vessels often incorporate towers, commonly constructed of various structures comprising aluminum tubing, which allow a navigation station to be placed at an elevated position above the deck of a watercraft which allows for superior visibility when maneuvering the vessel and when sighting fish, schools of baitfish, birds, weed lines, changes in water color, and other visible indicators of the presence of game fish in the local area. Such superior visibility due to the elevated position of the observer may provide a distinct advantage when the operator of the vessel is navigating, fishing, or performing other water activities. Various structures have been used in prior art to provide this elevated station. Some of these structures incorporate navigation stations, and some are merely elevated platforms from which observations may be made.

It is also well known in the art of yacht design, however, that it is desirable that the center of gravity of a vessel be held as low as reasonably possible so as to increase the transverse stability of the yacht. This is especially desired in oceangoing vessels, as such vessels may often encounter waves, wind driven swells, wave chop and wind which may act independently or together to cause the craft to roll and pitch in the seas. If such rolling and pitching exceeds acceptable limits the watercraft may capsize, endangering the occupants and causing significant financial loss. Thus it is desirable that the center of gravity of a vessel be as low as reasonably possible in order to increase the stability of the watercraft, enabling the watercraft to be safely operated in heavier weather conditions than it would otherwise be able to safely operate in. It is further well known in the art of watercraft design that the addition of towers, sometimes called tuna towers, on a watercraft operates to raise the center of gravity and thus negatively affect the transverse stability of the craft. It is for this reason that larger, heavier watercraft typically may be equipped with tuna towers, and smaller, lighter watercraft typically are not equipped with tuna towers, because the smaller, lighter watercraft may be rendered unstable by the addition of such towers due to their lighter weight and the raising of the center of gravity beyond an acceptable height.

An example of a typical tuna tower of the prior art is depicted and disclosed in U.S. Pat. No. 8,281,732 to Irvine. This U.S. patent discloses a boat tower conversion kit for converting from a half tower to a full tower without the need for removal and/or destruction of the original half tower. A custom hardtop incorporates a central core platform with several integral reinforcing plates. The plates provide structural support for the later expansion of the half tower by adding the upper tower section and upper platforms. Leg members and latter members of the upper and lower tower sections automatically mate with one another in coaxial alignment and are structurally secured to one another through the interfacing integral reinforcing plates. Integral channels, wiring conduits and tubes provide for electrical wiring of electrical and mechanical components in conjunction with a custom platform core. The disclosure depicted in Irvine clearly shows the disadvantage of the tuna tower construction of the prior art. The tower of Irvine, when fully deployed, raises the center of gravity of the boat by virtue of the fact that the center of mass of the tower is far above the deck of the vessel. This means that the tuna tower of Irvine, which is typical of the prior art, must be only used on a large vessel of significant size and weight, typically 35 feet or larger. The tower of Irvine is not usable on a smaller, lighter craft such as watercraft in the 20 to 30 foot range because it would unacceptably raise the center of gravity of the vessel, which would lead to dramatically reduced transverse stability of the vessel in heavy seas and would likely lead to capsizing of the vessel.

BRIEF SUMMARY OF THE INVENTION

The present invention comprises a system and/or method that have one or more of the following features and/or steps, which alone or in any combination may comprise patentable subject matter.

In accordance with one embodiment of the present invention, the improved secondary navigation station of the invention comprises a horizontal surface which is suspended above the watercraft by a structural system comprised of aluminum tubing, composite structural members or equivalent structure, which horizontal surface may further comprise a navigation station, a horizontally sliding cover which may also comprise a seat which, when it is in a closed position, operates in concert with said horizontal surface to create a complete weatherproof surface; but when open, allows the user or operator of the watercraft to mount a series of steps or other structure such that the user or operator of the watercraft is able to navigate the craft from an elevated position using a standing, leaning, or sitting position. Alternatively, the user may simply use the secondary navigation station to sight for fish while another person operates the boat from the lower console. The invention allows for an elevated navigation station and elevated positioning for sighting use for fishing and navigation while maintaining a low center of gravity of the watercraft. The improved secondary navigation station of the invention therefore represents a distinct advantage over the towers and similar structures of the prior art and, as at least one advantage over the prior art, allows for elevated sight fishing or navigation, or both, for watercraft which heretofore were considered too small for such structures.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

The following documentation provides a detailed description of the invention. In the figures of the drawings, the forward, aft, port, and starboard directions are indicated for reference. "Lengthwise" shall mean a direction that is parallel to the forward and aft direction as indicated in the figures of the drawings. "Occludes" shall be construed to mean "completely covering". The "open" position shall be construed as that position wherein cover 102 is translated along the sliding means and is located at the aft limit of travel of the sliding means such that the cover is located in a fully aft position. The "closed" position shall be construed as that position wherein cover 102 is translated along the sliding means and is located at the forward limit of travel of the sliding means such that cover 102 is located in a fully forward position.

Figure 1:
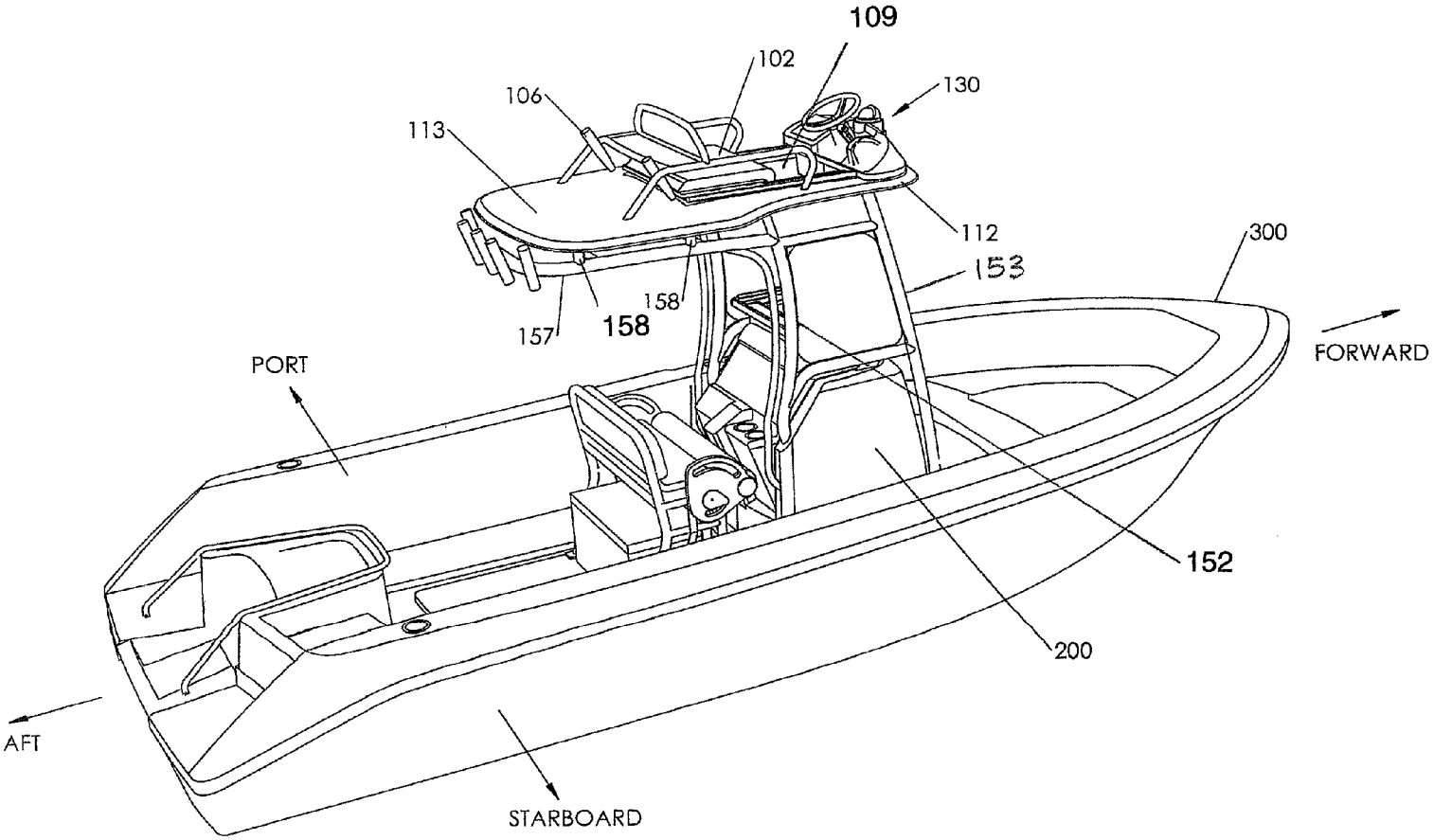
FIG. 1 depicts a perspective view of a preferred embodiment the secondary navigation station of the invention installed on a boat.
Figure 4A:
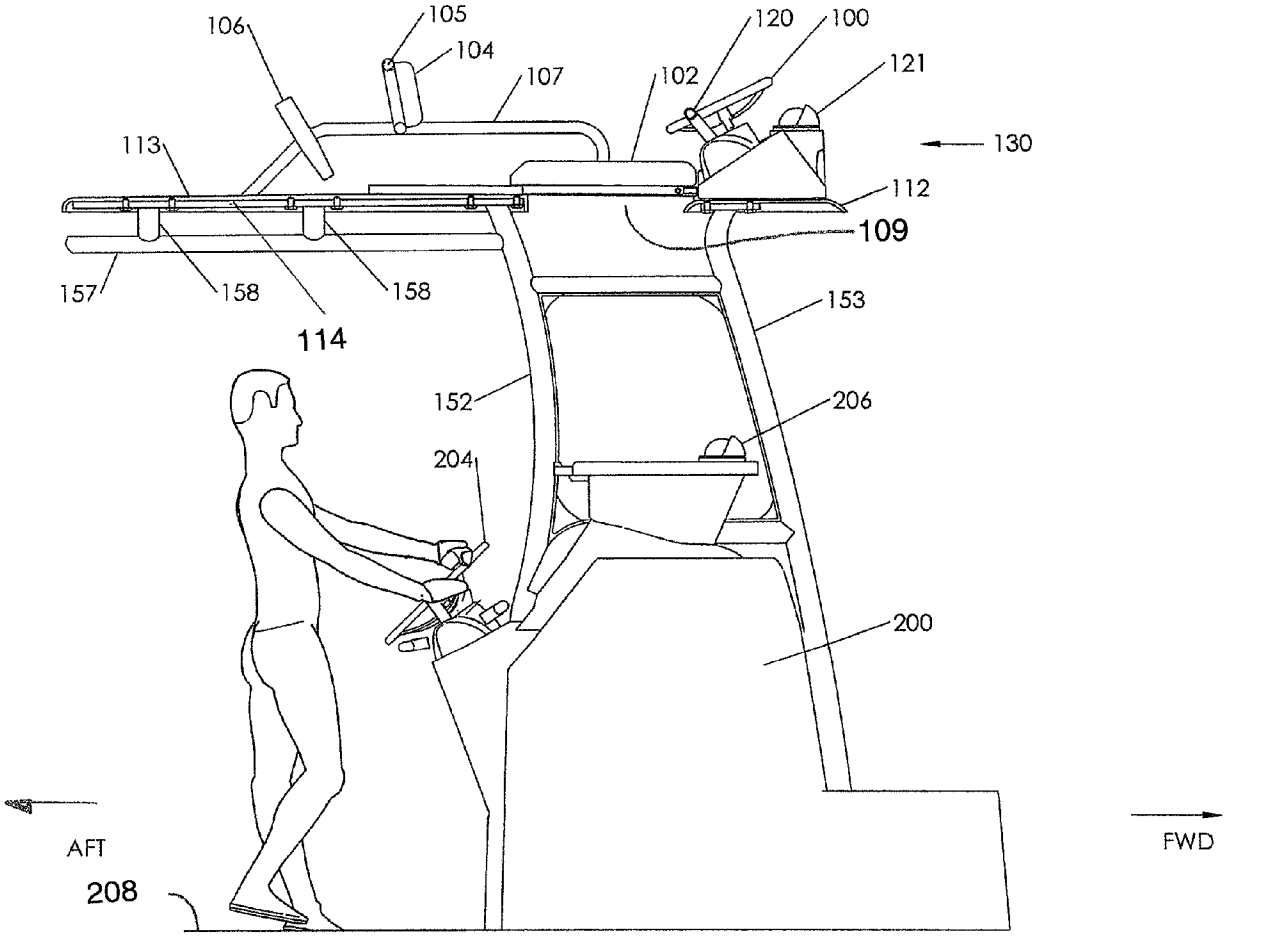
FIG. 4*a* depicts a side view of a preferred embodiment of the secondary navigation station of the invention, and also showing the support structure and lower primary console, in which the cover is disposed fully forward at the forward limit of travel of the sliding means in order to provide a covering while a user utilizes the lower primary navigation station to operate the watercraft.

Referring now to FIG. 1, a perspective view of a preferred embodiment of the secondary navigation station of the invention as it may be installed on a watercraft is shown. Secondary navigation station structure 112, which comprises a structure upper surface 113 and a structure lower surface 114 (not shown in FIG. 1), provides a structure for the features and elements of the improved secondary navigation station of the invention. Secondary navigation station structure 112 may be preferably, but not necessarily, substantially horizontal and substantially parallel with the surface of the water. Secondary navigation station 112 is typically attached to the watercraft by a structure system comprising, for instance, welded aluminum tubing which provides a structural base upon which secondary navigation station structure 112 is securely affixed by any means known in the art for affixing a cover, or hard top, to a watercraft. Such means for securely affixing a cover or hard top to a watercraft include but are not limited to bolting, integrated fiberglass structural elements that are connected by chemical bonding, or any other known attachment means. In a preferred embodiment the secondary navigation system of the invention is affixed to four support members which may be aluminum tubing of any cross sectional shape including round, square, rectangular, elliptical or any other cross sectional shape. In a preferred embodiment of the invention four support members which may comprise port and starboard support structure aft tubing 152 and port and starboard support structure forward tubing 153 which may be affixed to structure lower surface 114 and extend in a downward direction towards the deck of the watercraft where they may be affixed to lower primary console 200, the watercraft deck, or any other structure that is affixed to the watercraft. An exemplary means of attachment of secondary navigation station structure 112 to support structure aft tubing 152 and support structure forward tubing 153 is further depicted in FIG. 6 of the drawings. In this manner the secondary navigation station of the invention is securely affixed to the watercraft. The particular tubing or other structural member shape, means of attachment to the watercraft or type of materials used in the supporting attaching structure may be any shape or material known in the art of watercraft construction. In this manner, secondary navigation station structure 112 is securely affixed to the watercraft at a height above deck of the watercraft sufficient to allow a user to stand underneath the lower structure lower surface 114 of secondary navigation station structure 112 with enough headroom to comfortably operate and navigate watercraft 300. A preferred dimension for the distance from the surface upon which a user stands to operate the watercraft utilizing the controls of lower primary console 200 to the structure lower surface 114 of secondary navigation station structure 112 may be, for example, 6.5 feet or greater. However, the dimension for the distance from the surface upon which a user stands to operate the watercraft utilizing the controls of lower primary console 200 to the lower surface 114 of secondary navigation station structure 112 may be any dimension. The surface upon which a user stands to operate the watercraft utilizing controls of lower primary console 200 is depicted in FIG. 4*a* as item 208.

Still referring to FIG. 1, watercraft 300 has forward, aft, port and starboard directions as shown in the figure. On a typical water craft, lower primary console 200 typically comprises engine control and navigation equipment which is used to operate and navigate the watercraft. In the particular watercraft shown in FIG. 1, a "center console" watercraft configuration is depicted. While center console watercraft are very popular for small fishing watercraft such as the one depicted in FIG. 1, which may for example be a watercraft twenty-six feet or less in length, it is to be understood that the secondary navigation station of the invention may be utilized on any type of watercraft or any length of watercraft and is therefore not to be construed as being limited to center console watercraft. However, as watercraft size grows, it may be desirable to use a more traditional structure such as a tuna tower or like structure to provide an elevated siding position and secondary navigation station. The secondary navigation station of the invention may be utilized on any size watercraft.

Still referring to FIG. 1, secondary navigation station structure 112 is a fixed to support structure aft tubing 152 and support structure forward tubing 153 as discussed below and further depicted in FIG. 6 of the drawings. Secondary navigation station structure 112 comprises a structure upper surface 113 which forms the upper surface of the secondary navigation station of the invention. Cover 102 attaches to structure upper surface 113 by sliding means comprising port slide rail 111, starboard slide rail 103, port slide car 123 and starboard slide car 124 which are not identified in FIG. 1 but are depicted and identified in FIG. 5 of the drawings. The sliding means allows cover 102 to be slidingly engaged with structure upper surface 113 by operation of port and starboard slide cars 123 and 124 sliding within port and starboard slide rails 111 and 103, respectively. The sliding means may have a forward limit of travel and an aft limit of travel. The forward limit of travel may be defined as the point in which cover 102 covers structure opening 109. The aft limit of travel of the sliding means may be defined as the point at which the forward edge of cover 102 is aft of the aft edge of structure opening 109. The translation of cover 102 by operation of the sliding means allows a user to utilize structure opening 109 to operate the watercraft by protruding the user's body through structure opening 109 such that the user may operate the watercraft from a sitting position while sitting on cover 102 or to operate the watercraft from a standing position by leaning against either the forward edge of cover 102 or the aft edge of structure opening 109. Thus, the watercraft may be operated by a user from an elevated position, providing significant advantages to the user in sighting fish, observing the waterway for other watercraft which may be operating in the vicinity, and increasing visibility by reducing the effect of glare on the water surface.

Still referring to FIG. 1, secondary navigation station control console 130, which may comprise navigation and watercraft operating controls such as, for instance, steering control, engine throttles, engine gauges, navigation displays, chart plotters, and other navigation, engine, and instrumentation, may be mounted in a forward portion of structure upper surface 113 as shown. Secondary navigation station controls console 130 may be fabricated from any of the known materials used for boat construction including fiberglass, foam core fiberglass sandwich, carbon fiber, Kevlar, metal, plastic or any other material known in the art of boat construction. Secondary navigation station controls console 130 may be molded into a single piece with secondary navigation station structure 112, or may be fabricated separately and mounted to secondary navigation station structure upper surface 113 by using mechanical fasteners such as bolts, screws or rivets; or alternatively may be chemically bonded to secondary navigation station structure upper surface 113. The electrical and other cabling supporting the navigation, engine and instrumentation of secondary navigation station control console 130 may be routed through openings and channels provided by support structure aft tubing 152, support structure forward tubing 153 or other structural elements as described herein. A preferred embodiment of the secondary navigation station of the invention comprises secondary navigation station control console 130 preferably disposed at the forward end of structure upper surface 113; however alternate embodiments of the secondary navigation station of the invention may not comprise secondary navigation station controls console 130. In an alternate embodiment in which the secondary navigation station of the invention does not comprise secondary navigation station controls console 130, the invention is primarily usable as an elevated platform for improved visibility.

Referring to FIG. 1 still further, support structure horizontal tubing 157 is depicted as attaching to support structure aft tubing 152 by welding or any other known attachment means, and extending around the aft end of secondary navigation station structure 112. One or more support structure vertical members 158 may be disposed along an upper surface of support structure horizontal tubing 157 and may be attached thereto by welding or any other equivalent affixing means. Secondary navigation station structure 112 may be affixed to the upper ends of support structure vertical members 158 as further depicted in FIG. 6 and in the cross-sectional views of FIGS. 4*a*, 4*b* and 4*c*.

Figure 2A:
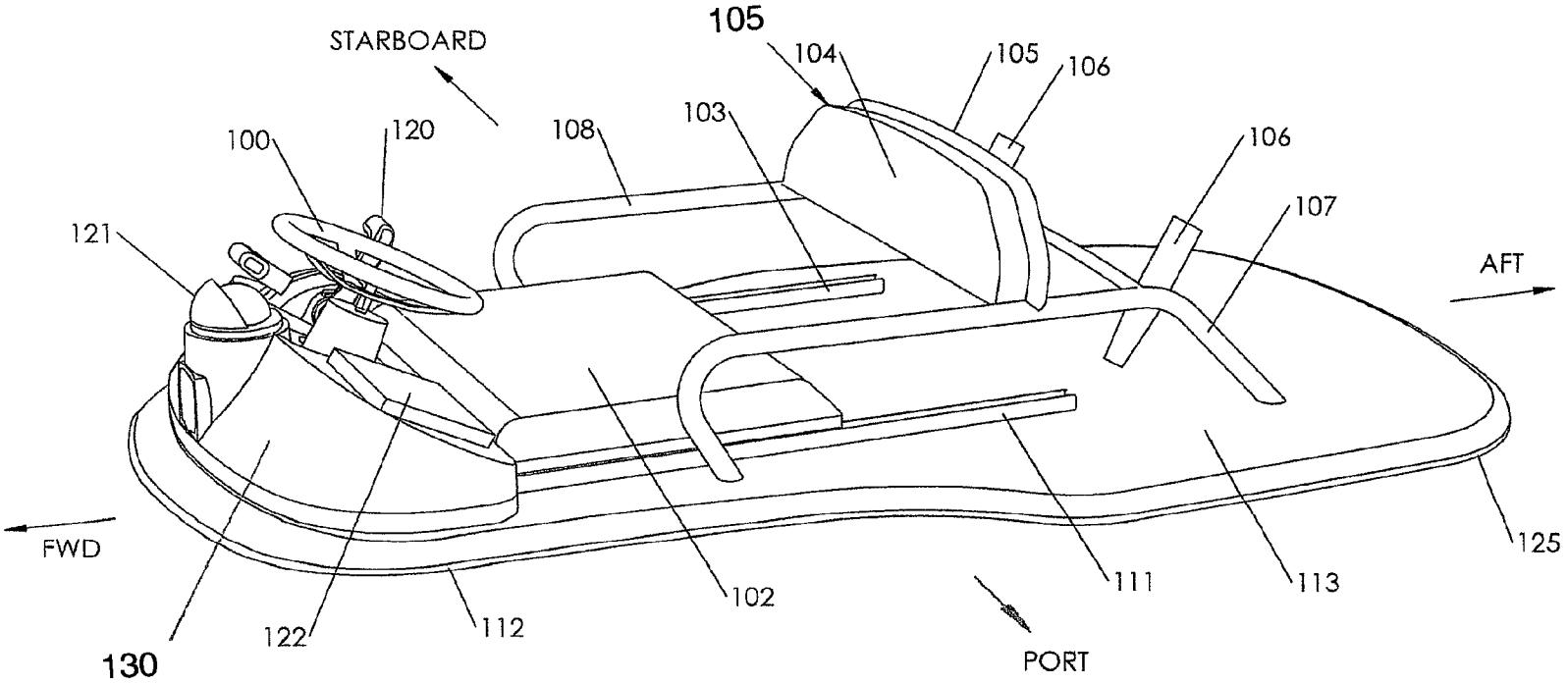
FIG. 2*a* depicts a perspective view of a preferred embodiment of the secondary navigation station of the invention in which the opening is closed by the cover being disposed in a fully forward position at the forward limit of travel of the sliding means.

Referring now to FIG. 2*a*, a perspective view of the secondary navigation station of the invention is shown. Secondary navigation station structure 112 may be fabricated from any known materials used in the art of watercraft construction including but not limited to a foam core with fiberglass layup on top and bottom, multiple fiberglass layups, carbon fiber, Kevlar, plastic or any other materials known in the art of watercraft construction. In a preferred embodiment, secondary navigation station structure 112 is comprised of multiple layers of fiberglass forming a unitary structure of sufficient strength to withstand the stresses typically encountered by watercraft. In still further alternate embodiments, secondary navigation station structure 112 may comprise a metal such as, for example, aluminum, or any other rigid structural material.

Referring still to FIG. 2*a*, secondary navigation station structure 112 has an outer perimeter 125 and a structure upper surface 113. Port handrail 107 and starboard handrail 108 are affixed to secondary navigation station structure 112 as further depicted in FIG. 7 and described further below. Port handrail 107 and starboard handrail 108 may be fabricated from any structural material suitable for watercraft construction but are preferably fabricated from aluminum tubing. Alternatively, stainless steel tubing may be used to fabricate Port handrail 107 and starboard handrail 108. Any other structural tubing of any cross-section including round, square, rectangular, elliptical or any other cross-section may be utilized to fabricate port handrail 107 and starboard handrail 108. Back rest support 105, which also may be fabricated from any structural material known in the art of watercraft construction including but not limited to aluminum tubing, stainless steel tubing, or any other tubing of any cross-sectional shape including circular, square, rectangular, elliptical or any other cross-sectional shape, is affixed to port handrail 107 and starboard handrail 108 by any attachment means known in the art such as, for example, welding, riveting or use of threaded fasteners. Back rest support 105 provides structural support for back rest 104. Back rest 104 is attached to backrest support 105 by any means known in the mechanical arts but may typically the threaded fasteners protruding through flanges having clearance holes disposed in backrest support 105 and whereby threaded fasteners such as bolts or screws protrude through said clearance holes into matching mail threaded in the aft surface of backrest 104. Backrest 104 may comprise a boat-style cushion with a cover as is known in the art of watercraft construction and may further comprise a rigid structural plate disposed on the aft side of the backrest, within the cover, to provide rigidity and support. The structural plate may be fabricated from any material known in the art for cushion support such as wood, plastic, metal such as, for instance, aluminum, structural composite materials such as foam core with fiberglass outer layers or layered fiberglass. One or more fishing rod holders 106 may be affixed to port handrail 107 or starboard handrail 108 by any means known in the art such as welding, riveting, clamping, threaded fasteners, chemical bonding, or any other attachment means known in the mechanical arts. Fishing rod holders 106 may be fabricated from any material known in the arts for fabricating fishing rod holders such as, for instance, aluminum, stainless steel, any metal, plastic, or any other material known in the mechanical arts. In the embodiment depicted in FIG. 2*a*, two fishing rod holders 106 are depicted as disposed aft of backrest 104 but it is to be understood that fishing rod holders 106 may be placed along port handrail 107 and starboard handrail 108 at any position.

Referring still to FIG. 2*a*, cover 102 is depicted as disposed at the forward limit of travel of the sliding means. In this fully forward position, cover 102 covers structure opening 109 (not shown in FIG. 2*a*). In a preferred embodiment of the secondary navigation station of the invention, cover 102 completely covers, or occludes, structure opening 109 and, in a still further preferred embodiment, provides a weathertight covering over structure opening 109. The sliding means may be any sliding means known in mechanical arts including channels with cars adapted to slide thereon, rails with cars adapted to slide there on, and any equivalent structure which may be interposed between two structures and provides a sliding mechanism. In the preferred embodiment shown, the sliding means comprises starboard slide rail 103 which is slidingly engaged with starboard slide car 124 (not shown in FIG. 2*a*) and port slide rail 111 which is slidingly engaged with port slide car 123 (not shown in FIG. 2*a*). Port slide car 123 and starboard slide cart 124 are affixed to the underneath surface of cover 102 and are adapted to be slidingly engaged with starboard slide rail 103 and port slide rail 111, respectively, as is further depicted in FIG. 5. It can be seen from FIGS. 2*a*-2*c*, 3*a*-3*c* and FIG. 5 that cover 102 may translate in a forward and aft direction to a forward limit of travel and an aft limit of travel and may be disposed at any point along the forward and aft travel of the sliding means.

Referring still to FIG. 2*a*, cover 102 may be any planar element but is preferably a seat which may be comprised of a cushion upper element and a structural element affixed to the cushion element and adapted to receive threaded fasteners. Preferably, the structural element is a planar element extending to the limits of the periphery of the cushion and is contained within an outer covering such that the seat appears as one unit with a cushion top and structural bottom. This is typical in watercraft seat construction. The use of a planar element in the bottom of the seat allows for the use of threaded fasteners to mount the seat on to other structures from the underneath side. In the present invention, a preferred embodiment of cover 102 is defined as a seat comprising a cushion top and structural element bottom that is adapted to threadingly engage mail fasteners such as bolts or screws from the underneath side. The attachment of the seat embodiment of cover 102 to port slide car 123 and starboard slide car 124 is further depicted in FIG. 5.

Still referring to FIG. 2*a*, secondary navigation station control console 130 may be disposed at the forward end of secondary navigation station structure 112 as shown. Secondary navigation station control console 130 may comprise secondary navigation station engine throttle controls 120, secondary navigation station compass 121, secondary navigation station multifunction display 122 such as a chart plotter, and steering element 100, which is adapted to the steering mechanism of the watercraft such that an operator may steer the watercraft using steering element 100. A user may operate and navigate the watercraft using secondary navigation station engine throttle controls 120 and steering element 100 which comprise secondary navigation station controls console 130. The use of secondary controls in conjunction with primary controls is well known in the engine control, navigation and watercraft construction art.

Referring now to FIGS. 2*b*-2*c* and 3*a*-3*c*, secondary navigation station structure 112, which has an outer perimeter 125, is again depicted. Port handrail 107 and starboard handrail 108 are affixed to structure upper surface 113 as described above. Backrest support 105 is affixed to port handrail 107 and starboard handrail 108 as described above, and backrest 104 is affixed to backrest support 105 as described above. Fishing rod holders 106 may be affixed to port handrail 107 and starboard handrail 108 as described above. Any number of fishing rod holders 106 may comprise the secondary navigation station of the invention. Secondary navigation station controls console 130, which may comprise steering element 100, secondary navigation station engine throttle controls 120, secondary navigation station compass 121 and secondary navigation station multifunction display, such as a chart plotter, 122 are depicted as being disposed at the forward end of secondary navigation station structure 112. It is not necessary that secondary navigation station controls console 130 be disposed at the forward end of secondary navigation station structure 112; this is simply the preferred embodiment and is the embodiment depicted in the figures of the drawings. The secondary navigation station controls console 130 may be disposed at any location on the secondary navigation station structure 112.

Figure 2B:
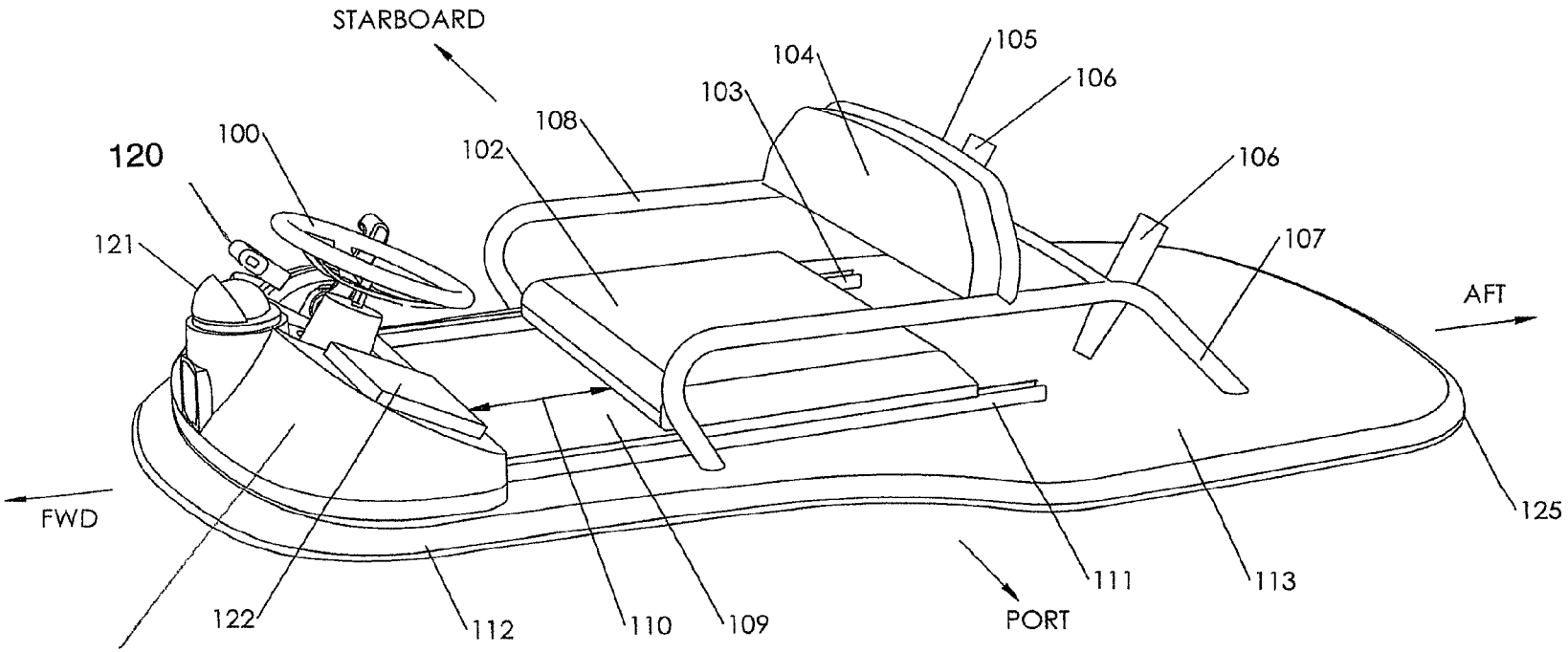
FIG. 2*b* depicts a perspective view of a preferred embodiment of the secondary navigation station of the invention in which the structure opening is partially open by the cover being disposed in a position that is between fully forward and fully aft, allowing a user to sit on the cover and therefrom operate the watercraft using the secondary navigation station operating controls.

Referring now to FIG. 2*b*, cover 102 is depicted as disposed along a point of travel of sliding means, which comprises starboard slide rail 103, port slide rail 111, port slide car 123 (not shown in FIG. 2*b*), and starboard slide cart 124 (not shown in FIG. 2*b*). When cover 102 is disposed at a position along the travel of the sliding means between the forward limit of travel of the sliding means and the aft limit of travel of the sliding means, structure opening 109 is revealed in whole or in part, depending upon the location of cover 102. Structure opening 109 allows a user to protrude up through structure opening 109 from below secondary navigation station structure 112 so as to access the controls of secondary navigation station controls console 130, to sit on cover 102, which may be a seat, or to simply lean against the forward edge of cover 102 while standing as depicted further in FIG. 4*c*. In FIG. 2*b*, cover 102 is depicted as disposed along a point of travel of the sliding means such that it may be used as a seat upon which a user may sit to operate the watercraft using secondary navigation station controls console 130 and is further depicted in FIG. 4*b*. A user may also position cover 102 at any point along the travel of the sliding means in order to adjust the position of cover 102 to be comfortable to the user as the user sits upon cover 102. The translation of cover 102 from its fully forward position as shown in FIG. 2*a* to its position as shown in FIG. 2*b* is indicated by arrow 110.

Figure 2C:
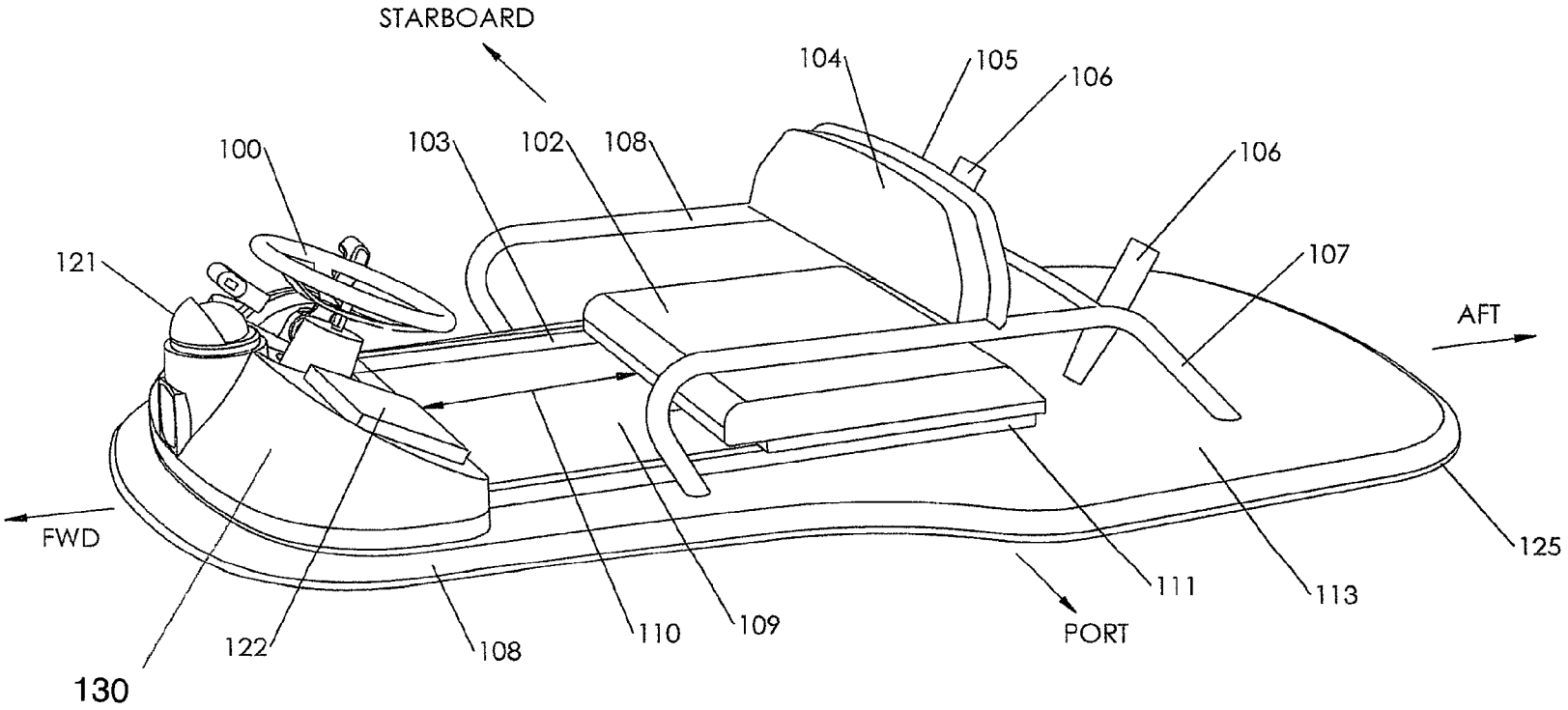
FIG. 2*c* depicts a perspective view of a preferred embodiment of the secondary navigation station of the invention in which the opening is fully open by the cover being disposed in a position that is fully aft to the aft limit of travel of the sliding means, allowing a user to lean against the cover as a leaning post while standing on a surface of the underneath primary navigation station.

Referring now to FIG. 2*c*, cover 102 is depicted as disposed at the aft limit of travel of the sliding means. In this fully aft position, structure opening 109 is completely revealed, allowing a user to protrude up through opening 109 from below secondary navigation structure 112 so as to lean against the forward edge of cover 102 or the aft edge of opening 109 and to operate the watercraft from this position utilizing secondary navigation station control 130, as is depicted further in FIG. 4*c*. Cover 102 may also be translated to be disposed at any point of travel along sliding means such that it is comfortable for the user to lean against in the manner shown in FIG. 4*c*. The translation of cover 102 from its fully forward position as shown in FIG. 2*a* to its position as shown in FIG. 2*c* is indicated by arrow 110.

Figure 3A:
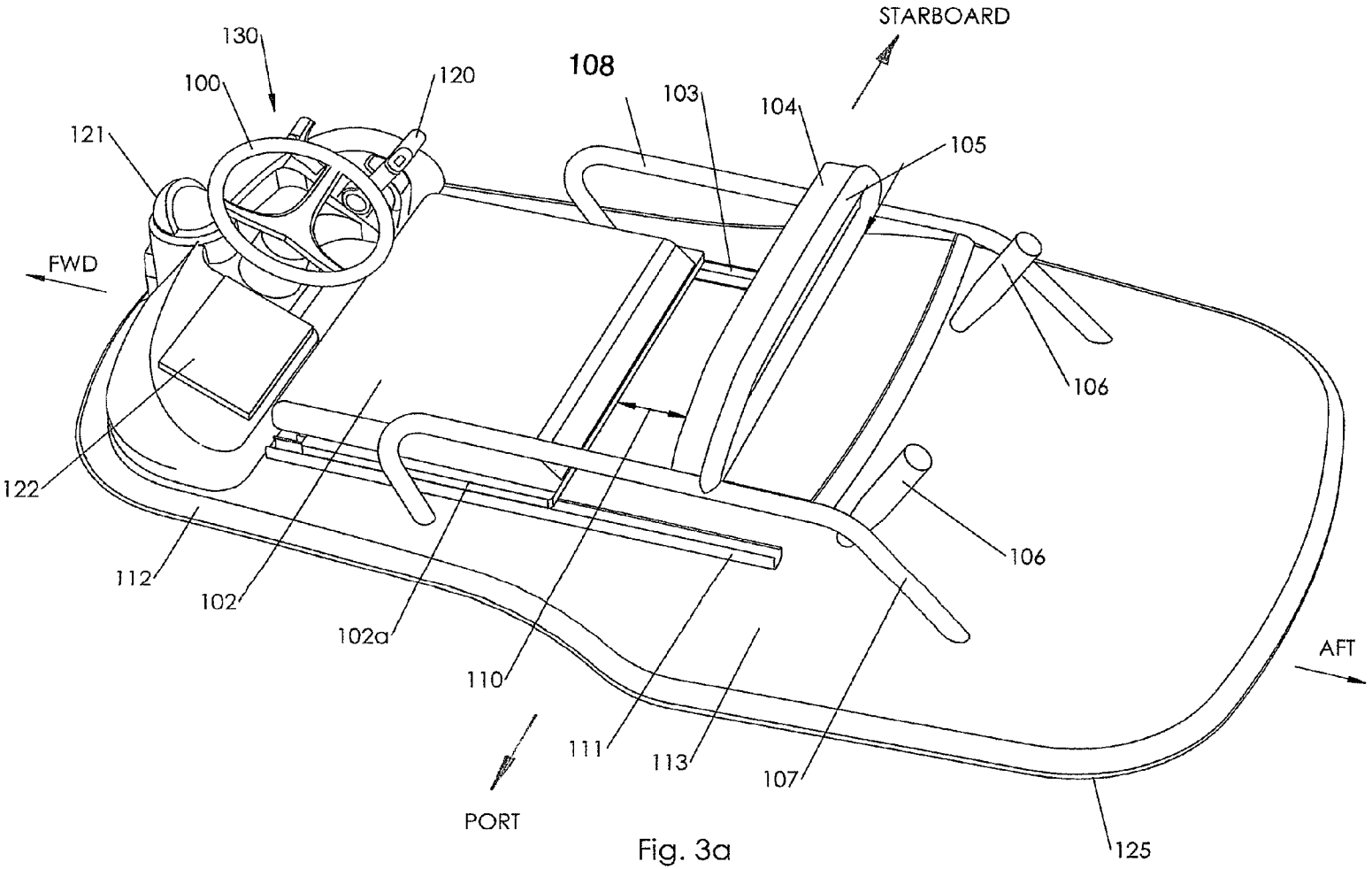
FIG. 3*a* depicts a top perspective view of a preferred embodiment of the secondary navigation station of the invention in which the opening is closed by the cover being disposed in a fully forward position at the forward limit of travel of the sliding means.

Referring now to FIG. 3*a*, cover 102 is depicted as disposed at the forward limit of travel of the sliding means. In this fully forward position, cover 102 covers structure opening 109 (not shown in FIG. 3*a*). In a preferred embodiment of the secondary navigation station of the invention, cover 102 completely covers, or occludes, structure opening 109 and, in a still further preferred embodiment, provides a weathertight covering over structure opening 109. The sliding means may be any sliding means known in mechanical arts including channels with cars adapted to slide thereon, rails with cars adapted to slide there on, and any equivalent structure which may be interposed between two structures and provides a sliding engagement. In the preferred embodiment shown, the sliding means comprises starboard slide rail 103 which is slidingly engaged with starboard slide car 124 (not shown in FIG. 3*a*) and port slide rail 111 which is slidingly engaged with port slide car 123 (not shown in FIG. 3*a*). Port slide car 123 and starboard slide cart 124 are affixed to the underneath surface of cover 102 and are adapted to be slidingly engaged with starboard slide rail 103 and port slide rail 111, respectively, as is further depicted in FIG. 5. It can be seen from FIGS. 2*a*-2*c*, 3*a*-3*c* and FIG. 5 that cover 102 may translate in a forward and aft direction to a forward limit of travel and an aft limit of travel and may be disposed at any point along the forward and aft travel of the sliding means. Cover 102 may be attached to cover mounting plate 102*a*, and cover mounting plate 102*a* may be attached to court slide car 123 (not shown in FIG. 3*a*) and starboard slide car 124 (not shown in FIG. 3*a*) as is further depicted in FIG. 5 of the drawings. Arrow 110 shows the direction of travel of cover 102 on the sliding means.

Figure 3B:
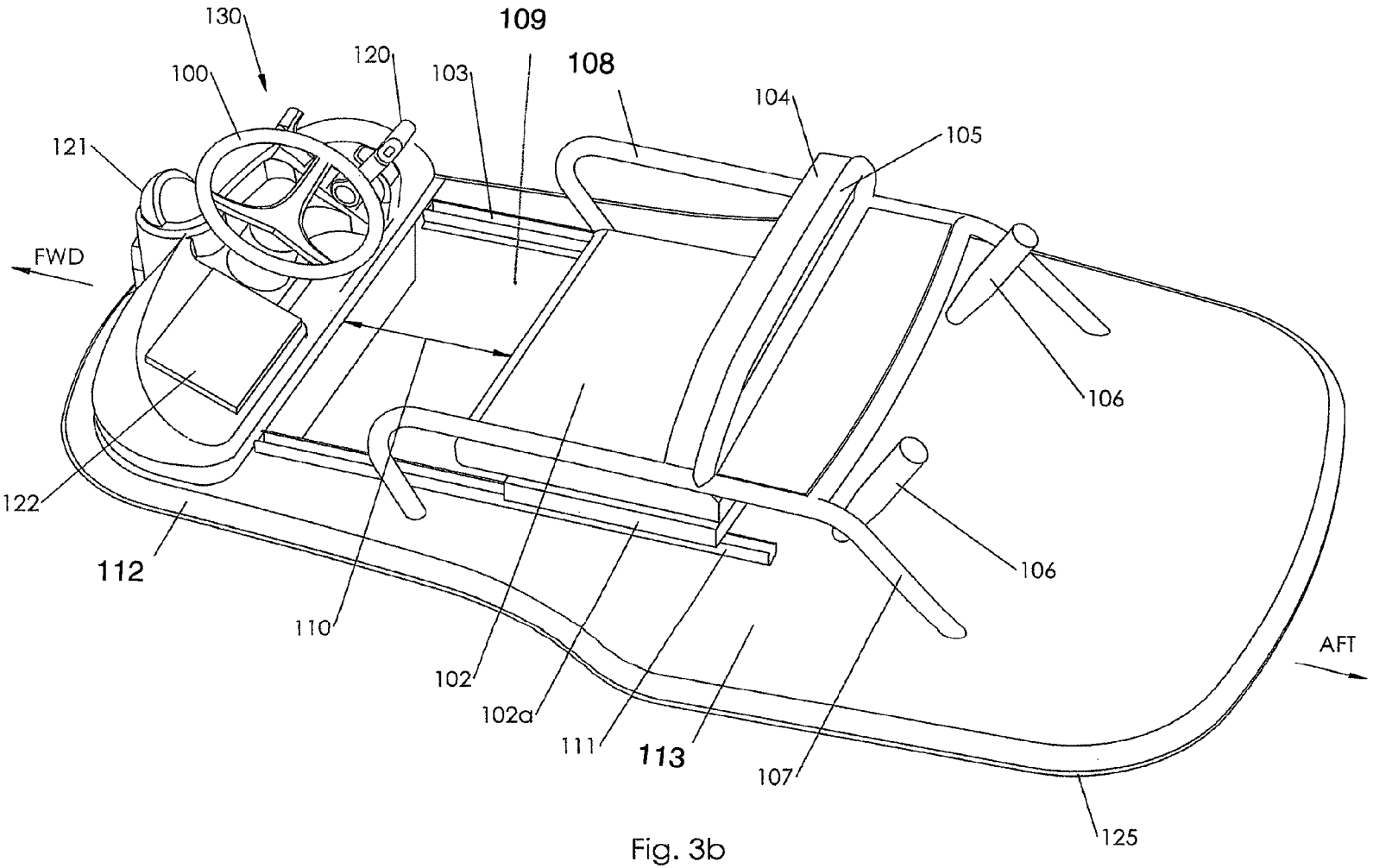
FIG. 3*b* depicts a top perspective view of a preferred embodiment of the secondary navigation station of the invention in which the opening is partially open by the cover being disposed in a position that is between fully forward and fully aft, allowing a user to sit on the cover and therefrom operate the watercraft using the secondary navigation station operating controls.

Referring now to FIG. 3*b*, cover 102 is depicted as disposed along a point of travel of sliding means, which comprises starboard slide rail 103, port slide rail 111, port slide car 123 (not shown in FIG. 3*b*), and starboard slide cart 124 (not shown in FIG. 3*b*). When cover 102 is disposed at a position along the travel of the sliding means between the forward limit of travel of the sliding means and the aft limit of travel of the sliding means, structure opening 109 is revealed in whole or in part, depending upon the location of cover 102. Structure opening 109 allows a user to protrude up through structure opening 109 from below secondary navigation station structure 112 so as to access the controls of secondary navigation station controls console 130, to sit on cover 102, which may be a seat, or to simply lean against the forward edge of cover 102 while standing as depicted further in FIG. 4*c*. In FIG. 3*b*, cover 102 is depicted as disposed along a point of travel of the sliding means such that it may be used as a seat upon which a user may sit to operate the watercraft using secondary navigation station controls console 130 and is further depicted in FIG. 4*b*. A user may also position cover 102 at any point along the travel of the sliding means in order to adjust the position of cover 102 to be comfortable to the user as the user sits upon cover 102. The translation of cover 102 from its fully forward position as shown in FIG. 3*a* to its position as shown in FIG. 3*b* is indicated by arrow 110. Cover 102 may be attached to plate 102*a*, and plate 102*a* may be attached to court slide car 123 (not shown in FIG. 3*b*) and starboard slide car 124 (not shown in FIG. 3*b*) as is further depicted in FIG. 5 of the drawings.

Figure 3C:
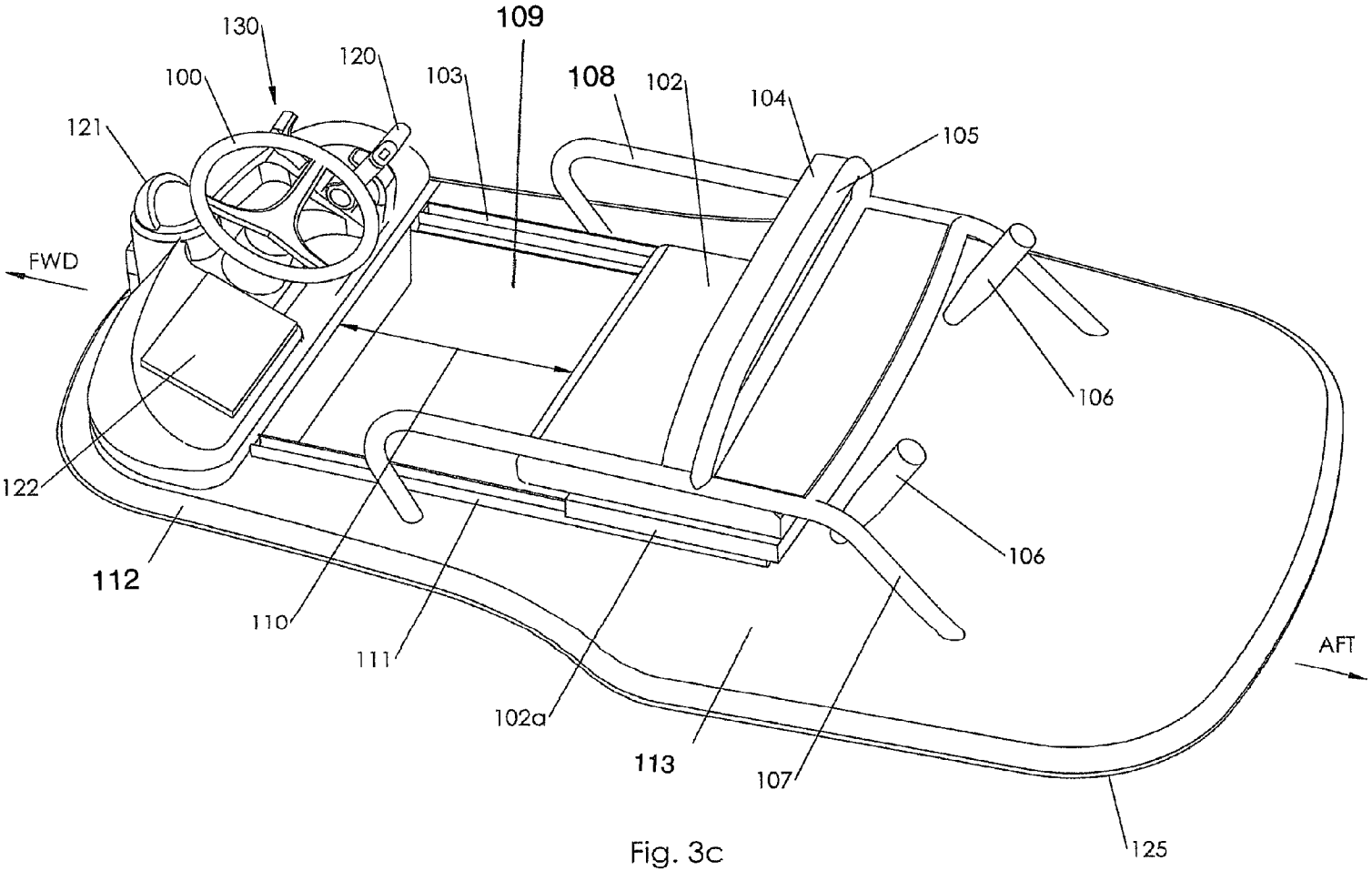
FIG. 3*c* depicts a top perspective view of a preferred embodiment of the secondary navigation station of the invention in which the opening is fully open by the cover being disposed in a position that is fully aft at the aft limit of the sliding means, allowing a user to lean against the cover as a leaning post while standing on a surface of the underneath primary navigation station.

Referring now to FIG. 3*c*, cover 102 is depicted as disposed at the aft limit of travel of the sliding means. In this fully aft position, structure opening 109 is completely revealed, allowing a user to protrude up through structure opening 109 from below secondary navigation station structure 112 so as to lean against the forward edge of cover 102 or the aft edge of structure opening 109 and to operate the watercraft from this position utilizing secondary navigation station controls console 130, as is depicted further in FIG. 4*c*. Cover 102 may also be translated to be disposed at any point of travel along sliding means such that it is comfortable for the user to lean against in the manner shown in FIG. 4*c*. The translation of cover 102 from its fully forward position as shown in FIG. 3*a* to its position as shown in FIG. 3*c* is indicated by arrow 110. Cover 102 may be attached to cover mounting plate 102*a*, and cover mounting plate 102*a* may be attached to court slide car 123 (not shown in FIG. 3*b*) and starboard slide car 124 (not shown in FIG. 3*b*) as is further depicted in FIG. 5 of the drawings.

Figure 4B:
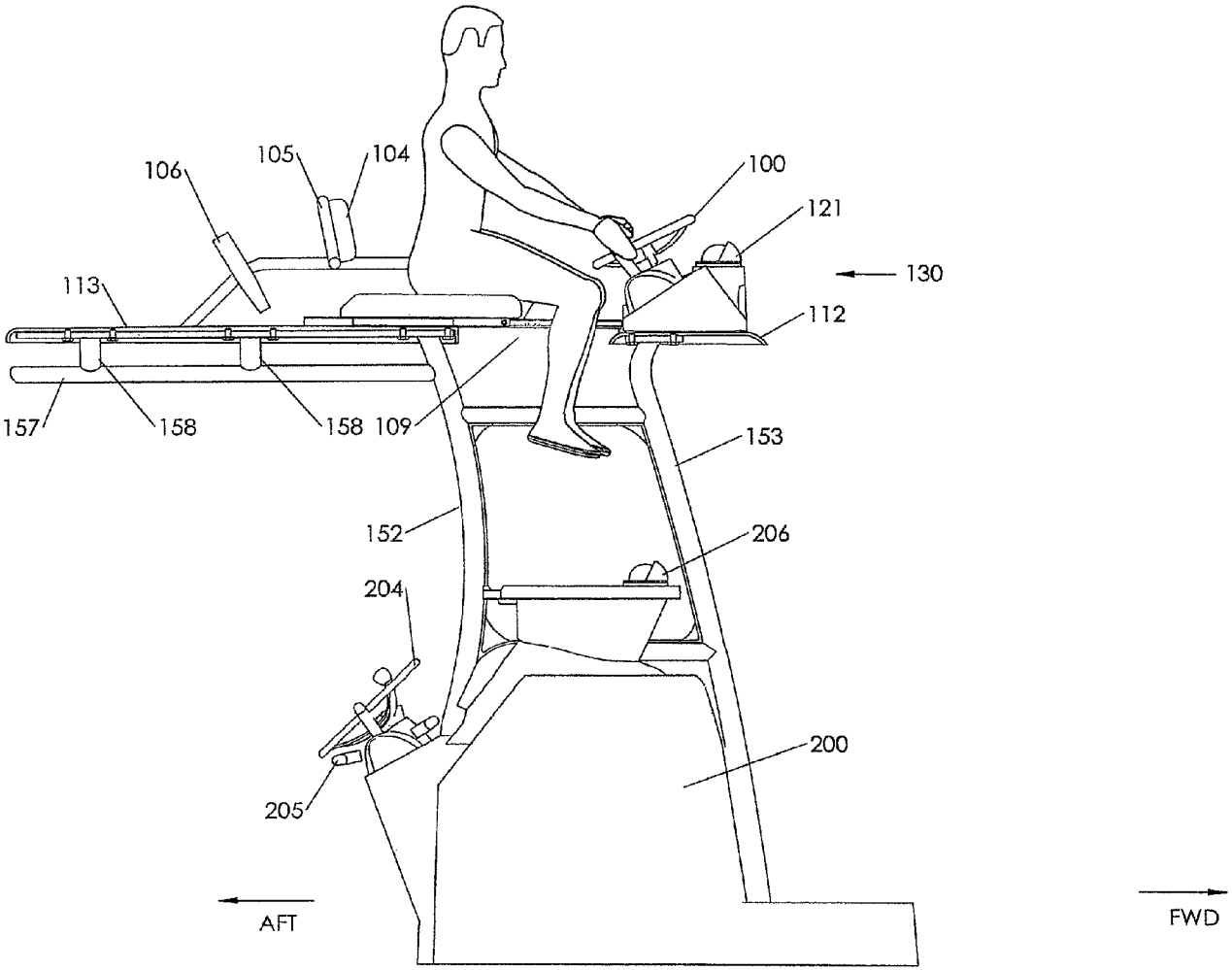
FIG. 4*b* depicts a side view of a preferred embodiment of the secondary navigation station of the invention, and also showing the support structure and lower primary console, in which the cover is partially opened in order to provide a seat upon which the user or operator of the watercraft may sit while the user operates the watercraft from the secondary navigation station of the invention.
Figure 4C:
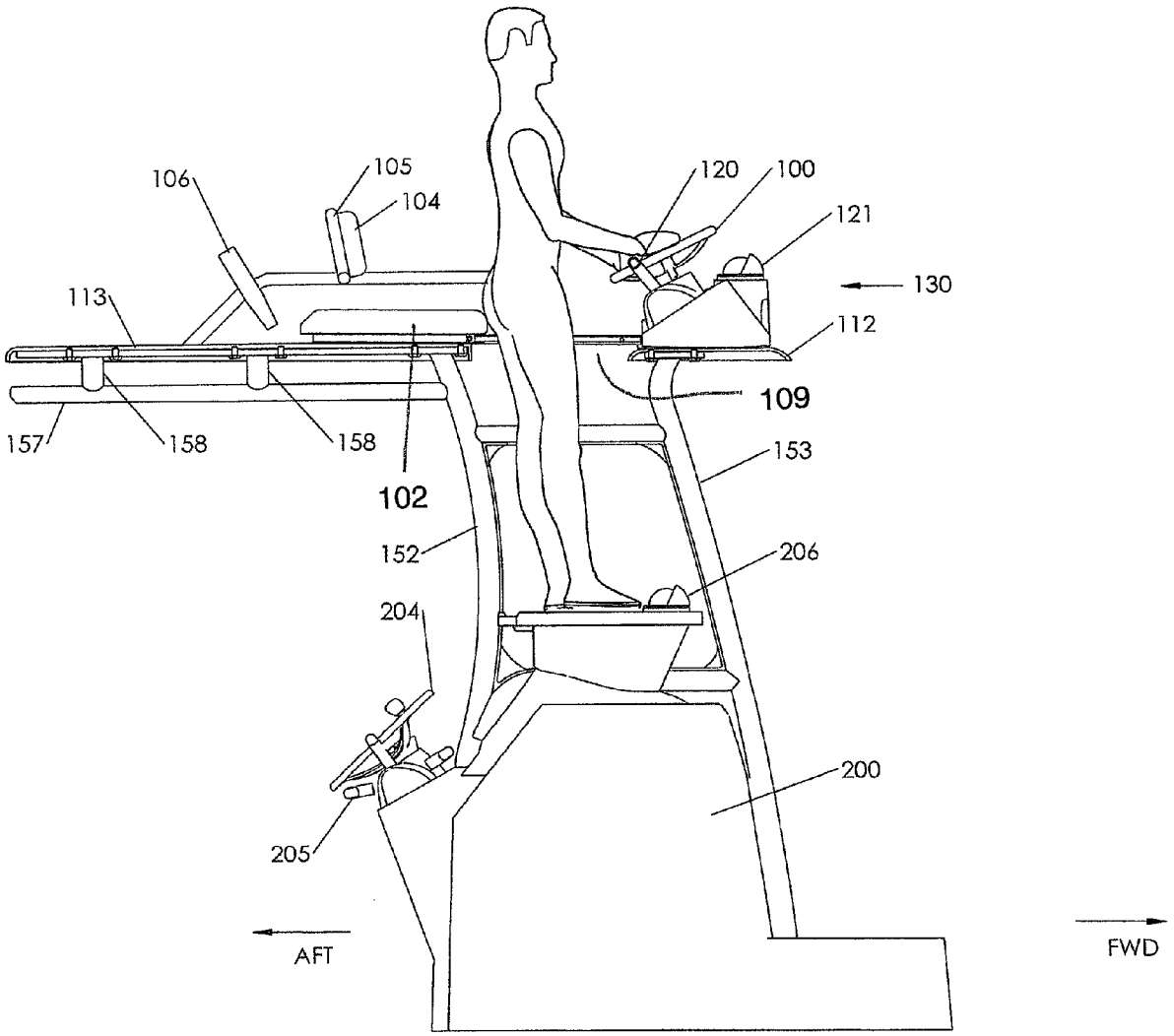
FIG. 4*c* depicts a side view of a preferred embodiment of the secondary navigation station of the invention, and also showing the support structure and lower primary console, in which the cover is disposed fully aft at the aft limit of the sliding means, allowing a user to lean against the cover as a leaning post while standing on a surface of the underneath primary navigation station.

Referring now to FIGS. 4*a*, 4*b* and 4*c*, a side view of a preferred embodiment of the secondary navigation station of the invention is depicted. Also shown are the support structure to which the secondary navigation station structure 112 attaches and lower primary console 200, which contains lower primary console steering element 204, lower primary console engine throttle controls 205 and lower primary console compass 206. Support structure aft tubing 152 and support structure forward tubing 153 extend in the vertical direction and support and attached to secondary navigation structure lower surface 114 in order to provide a secure attachment for the secondary navigation station of the invention. Additional detail regarding the attachment of secondary navigation station structure 112 to the supporting structure is depicted in FIG. 6. Support structure horizontal tubing 157 is attached to support structure aft tubing 152 by any means known in the art such as, for example, welding, mechanical fasteners such as bolts or rivets, chemical bonding or any other means. Likewise, support structure vertical members 158 attached to support structure horizontal tubing 157 in the same manner and extend upward to support structure mounting plate 150, which is attached to support structure vertical members 158, support structure aft tubing 152, and support structure forward tubing 153 by any means known in the art such as, for example, welding, mechanical fasteners such as bolts or rivets, chemical bonding or any other means. Bolts 154 may pass through clearance holes in support structure mounting plate 150 to be threateningly engaged with receiving male threaded holes in secondary navigation station structure 112, as depicted in further detail in FIG. 6. Secondary navigation station controls console 130 which may comprise steering element 100 secondary navigation station engine throttle controls 120, and secondary navigation station compass 121 may be disposed on the forward end of secondary navigation station structure 112. In FIGS. 4*a*, 4*b* and 4*c* secondary navigation station structure 112 is shown in cross-section. Port handrail 107 is attached to secondary navigation station structure upper surface 113. Back rest 104, which may comprise a cushion, is attached to backrest support 105 as herein described. Backrest support 105 is attached to port handrail 107 by any means known in the art for attaching structural tubing including, for example, welding, mechanical fasteners such as bolts or rivets, chemical bonding, or any other means known in the art. Fishing rod holder 106 is attached to port handrail 107 as herein described.

Referring specifically now to FIG. 4*a*, cover 102 is depicted as disposed at the forward limit of travel of the sliding means. In this fully forward position, cover 102 covers structure opening 109. In a preferred embodiment of the secondary navigation station of the invention, cover 102 completely covers, or occludes, structure opening 109 and, in a still further preferred embodiment, cover 102 provides a weathertight covering over structure opening 109. As depicted in FIG. 4*a* when cover 102 is disposed at the forward limit of travel of the sliding means in a fully forward position, a user typically operates the watercraft by controlling the watercraft from lower primary console 200. The user typically stands on lower primary console standing surface 208, which may, for example, be a deck of the watercraft. In this manner, the user or operator of the watercraft is protected from the elements by the closed cover 102 and the secondary navigation station structure 112 acting as a weather shield.

Referring now specifically to FIG. 4*b*, cover 102 is depicted as disposed along a point of travel of sliding means between the forward limit of travel of the sliding means and the aft limit of travel of the sliding means. When cover 102 is disposed at a position along the travel of the sliding means between the forward limit of travel of the sliding means and the aft limit of travel of the sliding means, structure opening 109 is revealed in whole or in part, depending upon the location of cover 102. Structure opening 109 allows a user to protrude up through structure opening 109 from below secondary navigation station structure 112 so as to access the controls of secondary navigation station controls console 130, to sit on cover 102, which may be a seat. As shown in FIG. 4*b*, a user may operate the watercraft when sitting upon cover 102, which may be a seat, and allowing the user's legs to protrude through opening 109. The user may easily reach the watercraft controls comprising secondary navigation station controls console 130 and may thereby operate the watercraft.

Referring now specifically to FIG. 4*c*, cover 102 is depicted as disposed at the aft limit of travel of the sliding means. In this fully aft position, structure opening 109 is completely revealed, allowing a user to protrude up through structure opening 109 from below secondary navigation station structure 112 so as to lean against the forward edge of cover 102 or the aft edge of structure opening 109 and to operate the watercraft from this position utilizing secondary navigation station controls console 130. Cover 102 may also be translated to be disposed at any point of travel along sliding means such that it is comfortable for the user to lean against in the manner shown in FIG. 4*c*. As shown in FIG. 4*c*, a user may operate the watercraft when standing upon a surface of lower primary console 200, whereby his torso may protrude through structure opening 109 such that the user may easily reach the watercraft controls comprising secondary navigation station operating console 130 and may thereby operate the watercraft.

Figure 5:
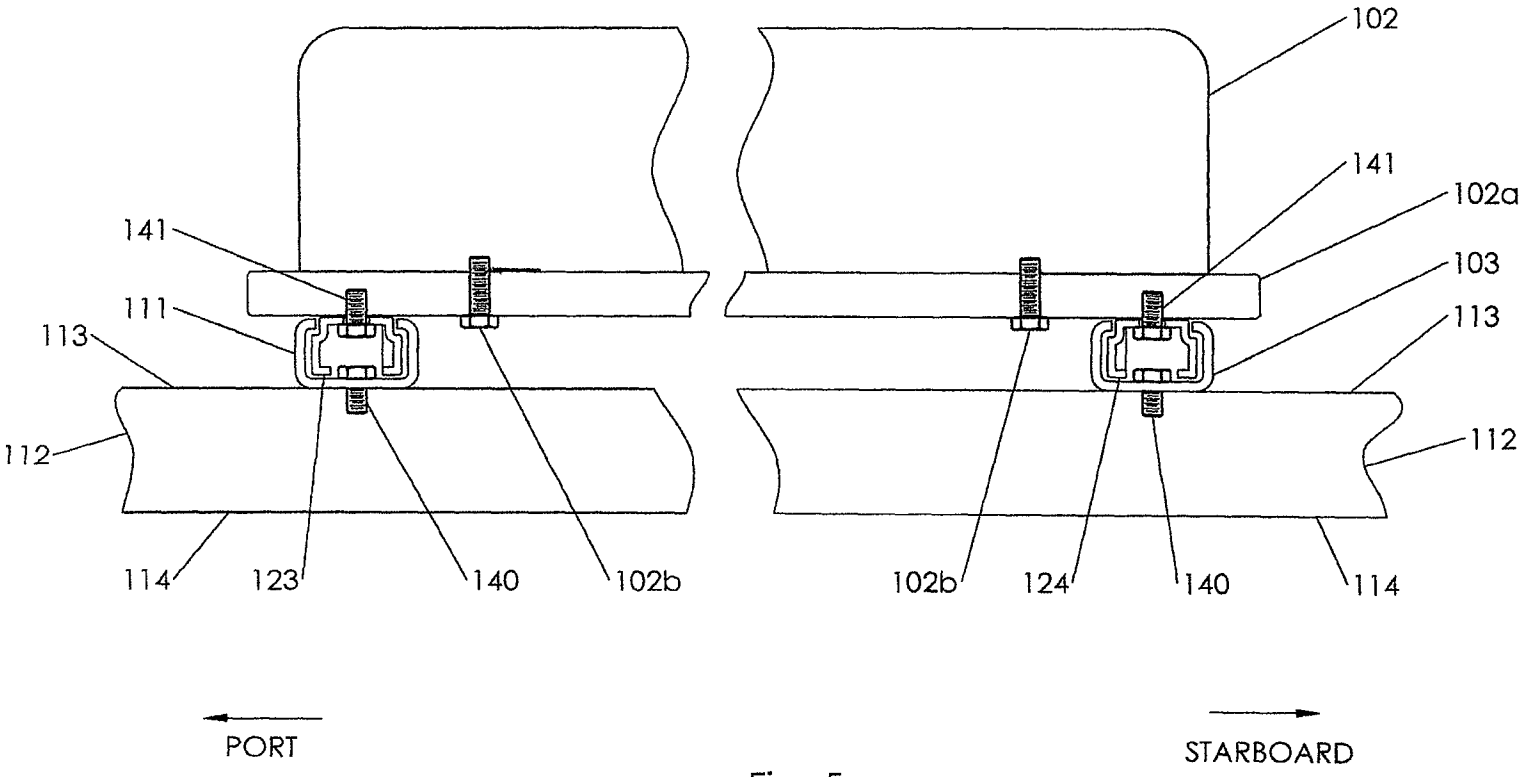
FIG. 5 depicts a cross sectional view of the cover and the sliding means of a preferred embodiment of the invention.

Referring now to FIG. 5, an embodiment for attachment of cover 102, which may be a seat, to the sliding means is shown. Secondary navigation station structure 112 has a structure upper surface 113 to which port slide rail 111 and starboard slide rail 103 may be attached by means of slide rail mounting bolts 140 which pass through clearance holes in port slide real 111 and starboard slide rail 103 and maybe retained by matching threaded female holes in secondary navigation station structure 112. Port slide car 123 and starboard slide car 124 may be attached to either cover mounting plate 102*a* or directly to the bottom surface of cover 102 by slide car mounting bolts 141 which may protrude through clearance holes in port slide car 123 and starboard slide car 124 to be threadingly engaged with matching female threaded holes in cover mounting plate 102*a* or in the bottom surface of cover 102 if cover mounting plate 102*a* is not used. The use of cover mounting plate 102 is optional. If cover mounting plate 102*a* is used, cover mounting bolts 102*b* may protrude through clearance holes in cover mounting plate 102*a* to be retained by matching female threaded holes in the bottom surface of cover 102. Secondary navigation station structure lower surface 114 is shown for reference. It can be seen that port slide cart 123 is slidingly engaged with port slide rail 111 and starboard slide cart 124 is slidingly engaged with starboard slide rail 103. This sliding engagement provides a sliding means that allows the translation of cover 102 lengthwise as depicted by arrow 110 in FIGS. 2*b*, 2*c*, 3*b*, and 3*c*.

Figure 6:
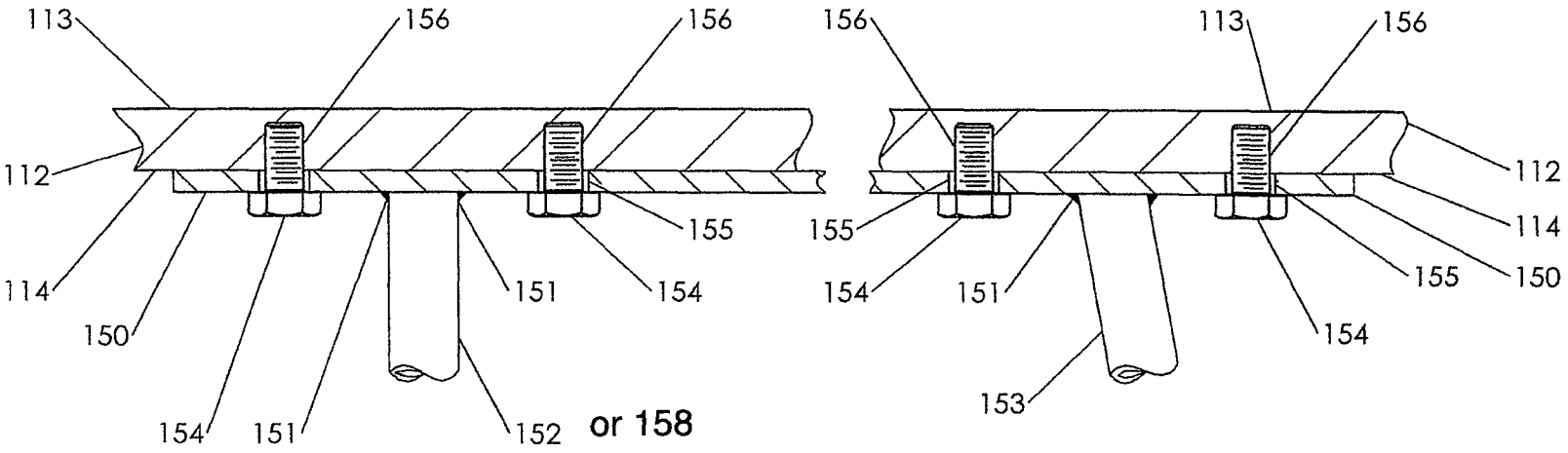
FIG. 6 depicts a cross sectional view of the support structure mounting plate attachment to a lower surface of the structure, and showing a preferred embodiment of the attaching hardware.

Referring now to FIG. 6, a cross sectional view of the support structure mounting plate attachment to secondary navigation station structure lower surface 114 is shown. Support structure aft tubing 152, support structure forward tubing 153, and support structure vertical members 158 attached to support structure mounting plate 150 by any means known in the art such as, for example, welding, the mechanical fasteners including bolts or rivets, chemical bonding or other attachment means known in the art. In the embodiment depicted in FIG. 6, welds 151 are shown as attachment means. Bolts 154 protrude through support structure clearance holes 155 in support structure mounting plate 150 and are threadingly engaged in receiving female threaded holes 156 in structure lower surface 114 of secondary navigation station structure 112. Secondary navigation station structure upper surface 113 is shown for reference. It can clearly be seen from FIG. 6 that secondary navigation station structure 112 is securely attached to support structure aft tubing 152 and support structure forward tubing 153, thereby securely holding the secondary navigation station of the invention in place on the watercraft.

Figure 7:
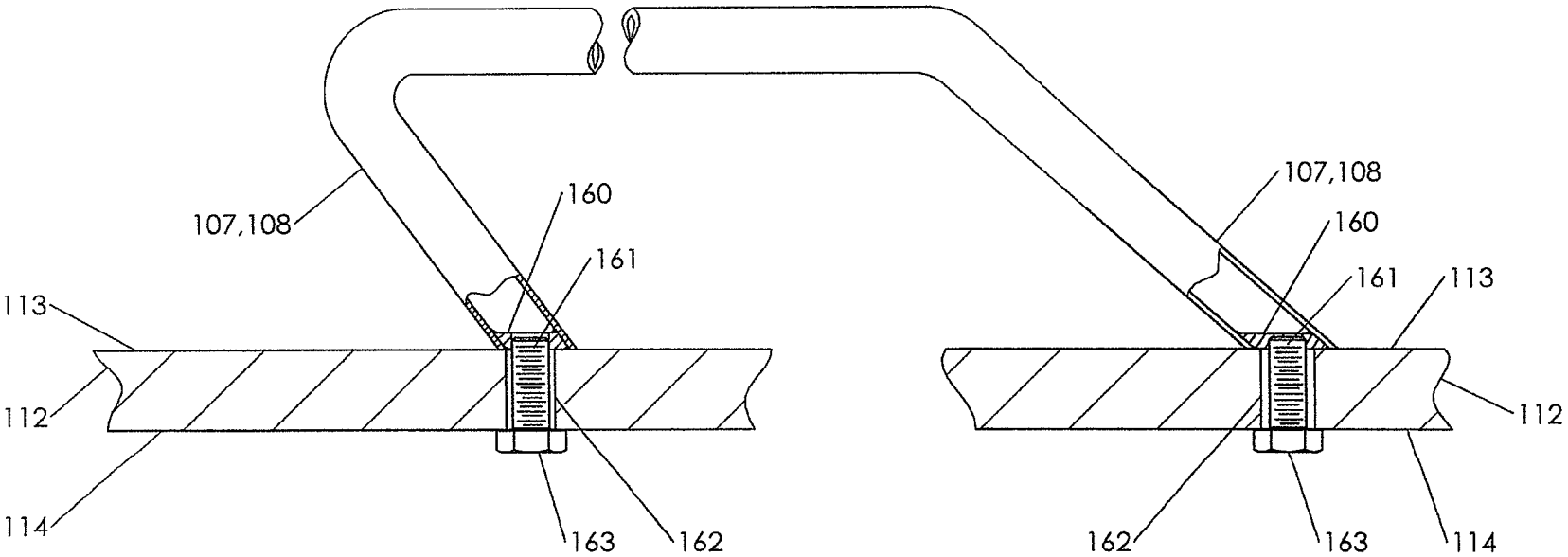
FIG. 7 depicts a cross sectional view of the handrail mounting to the upper surface of the structure, and showing a preferred embodiment of the attaching hardware.

Referring now to FIG. 7, a cross sectional view of the handrail mounting to the upper surface of the structure showing a preferred embodiment of the attaching hardware is depicted. Port handrail 107 and starboard handrail 108 may be attached to secondary navigation station structure upper surface 113 as shown in FIG. 7. In a preferred embodiment, port handrail 107 and starboard handrail 108 are comprised of tubing. Handrail threaded end plate 160 may be attached to the lower end of port handrail 107 and starboard handrail 108 by any means known in the art such as, for example, welding or chemical bonding. Handrail threaded end plate 160 may comprise a female threaded hole 161 adapted to receive handrail mounting bolt 163 which protrudes up through structure lower surface 114 of secondary navigation station structure 112 as depicted in FIG. 7. Handrail mounting bolt clearance holes 162 may be provided in secondary navigation station structure 112 to allow handrail mounting bolts 163 two protrude through secondary navigation station structure 112 as depicted in FIG. 7. In this manner, port handrail 107 and starboard handrail 108 may be securely attached to structure upper surface 113 of secondary navigation station structure 112. The attachment means depicted in FIG. 7 is exemplary. All equivalent forms of attachment means known in the art are within the scope of the claims.

Figure 8:
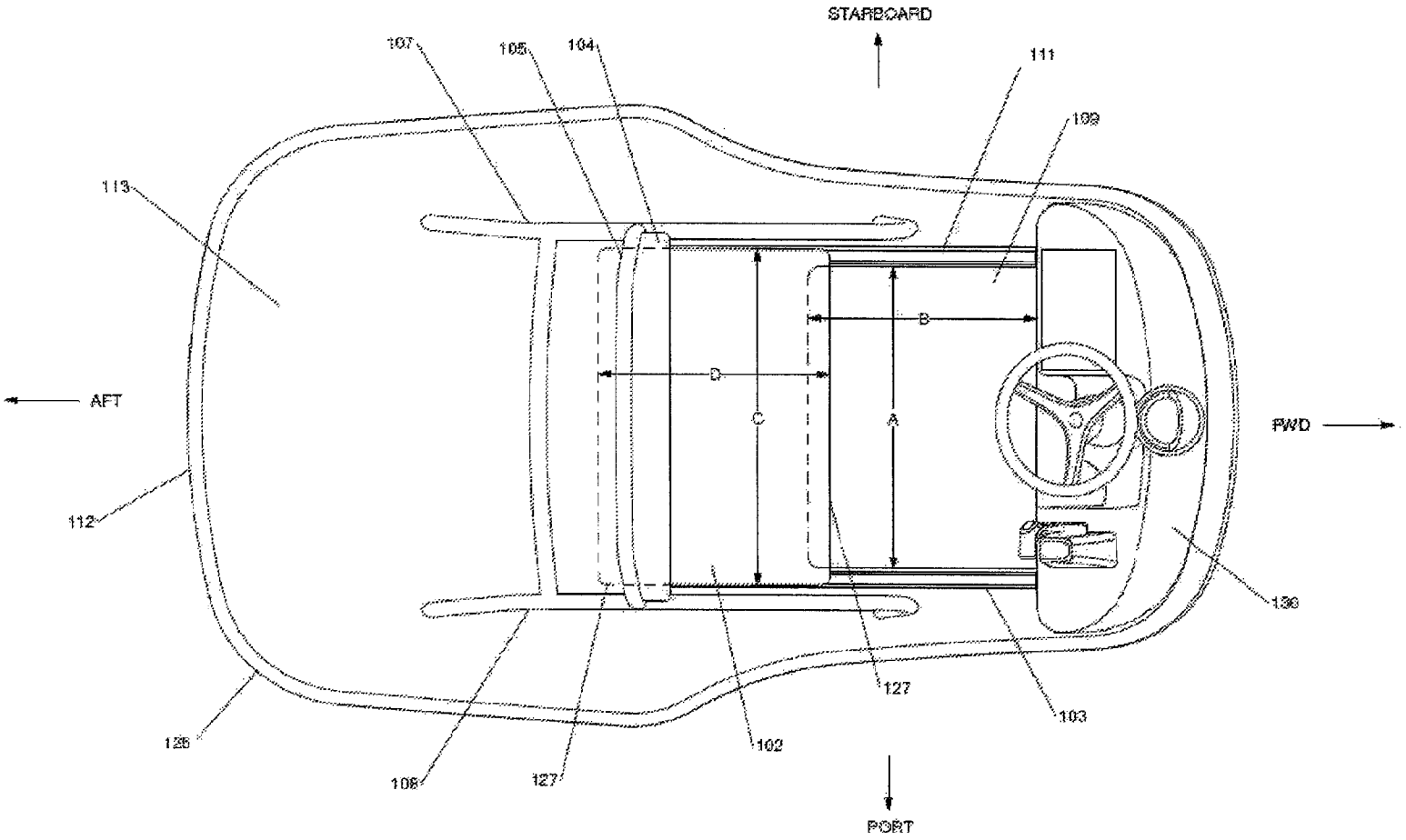
FIG. 8 depicts a top view of a preferred embodiment of the secondary navigation station of the invention with the cover, which may be a seat, is shown separately for clarity.

Referring now to FIG. 8, a top view of a preferred embodiment of the secondary navigation station of the invention is shown in which cover 102, which may be a seat, is shown separately for clarity. Secondary navigation station controls console 130 is preferably, but not necessarily, disposed at the forward end of secondary navigation station structure 112. Secondary navigation station structure 112 has a perimeter 125. Port handrail 107 and starboard handrail 108 are attached to secondary navigation station structure upper surface 113. Backrest 104 is attached to backrest support 105. Cover 102 may translate in the direction of arrow 110 by operation of sliding means as hereinbefore described. Starboard slide rail 103 and port slide rail 111 are shown for reference. Structure opening 109, which is located preferably toward the forward limit of travel of the sliding means, is shown as having a width A, a depth B and an opening perimeter 126. Likewise, cover 102 is shown as having a width C, a depth D and a cover outer perimeter 127. In a preferred embodiment of the secondary navigation station of the invention, dimension C of cover 102 is greater than dimension A of structure opening 109. Likewise, dimension D of cover 102 is greater than dimension B of structure opening 109. It can thus be seen, in a preferred embodiment of the invention, that cover 102 occludes structure opening 109 when cover 102 is translated lengthwise on the sliding means such that it is disposed at the foreword limit of travel of the sliding means. Cover 102 being disposed at the forward limit of travel of the sliding means is also depicted in FIGS. 2*a*, 3*a*, and 4*a*.

It can easily be seen in the various figures that cover 102, which may further be defined as a seat, may be positioned in an open position which is defined as cover 102 translated to the aft limit of travel of the sliding means so as to be fully aft, a closed position which is defined as cover 102 being translated to the forward limit of travel of the sliding means so as to be fully forward, or any position between an open position and a closed position to suit the ergonomic desires of the user or operator as the user or operator sits on the cover or leans against it as depicted in FIGS. 4*b* and 4*c*, or operates the watercraft from lower primary console 200 and may be protected from the weather by the cover being in a closed position as depicted in FIG. 4*a*.

Figure 9A:
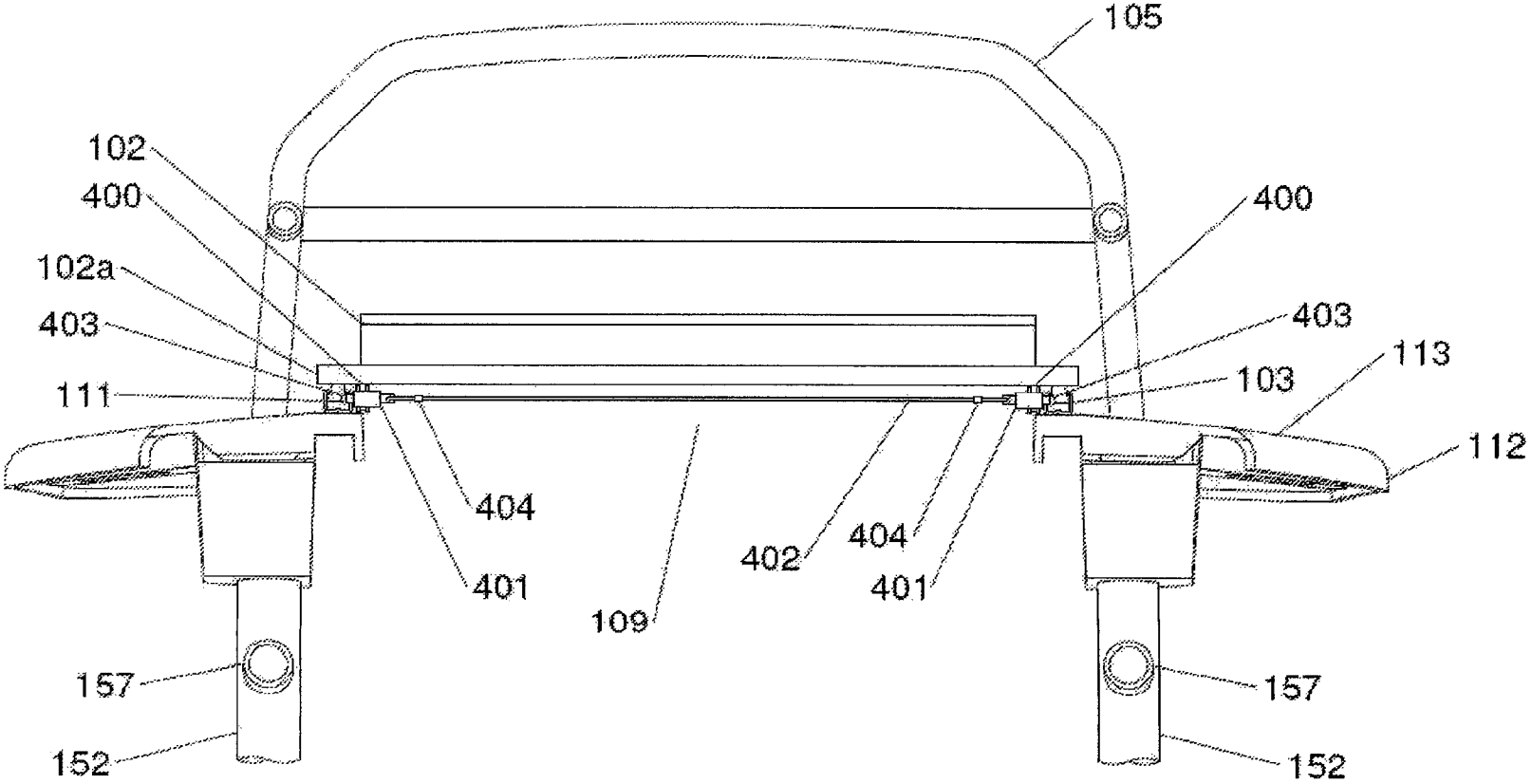
FIG. 9*a* depicts a rear view of an alternate embodiment of the secondary navigation station structure showing structure for securely locking the cover into discrete positions of travel along the sliding means in which the spring loaded pins are extended into receiving holes in the slide rails, retaining the cover in position and preventing translation of the cover along the sliding means.
Figure 9B:
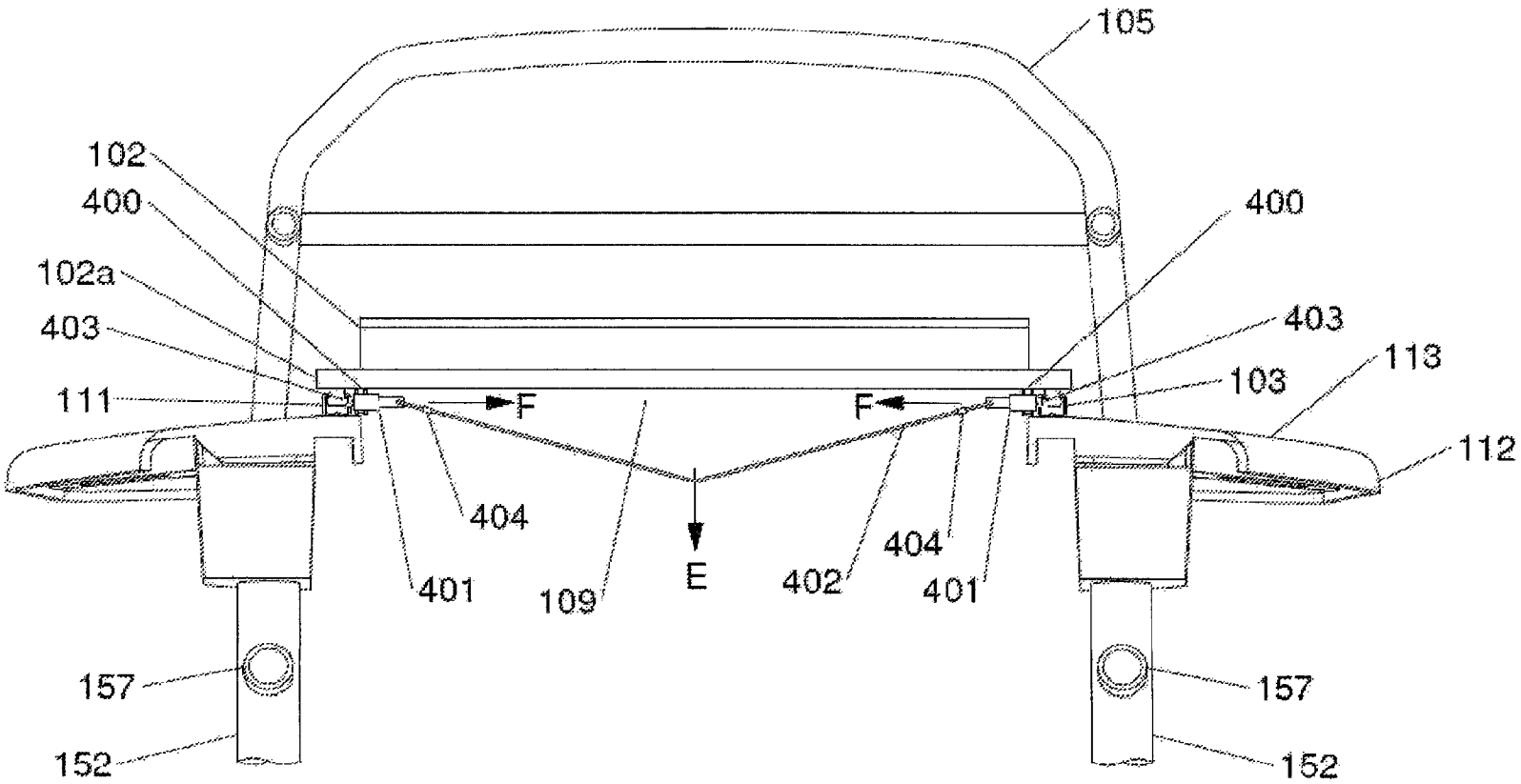
FIG. 9*b* depicts a rear view of an alternate embodiment of the secondary navigation station structure showing structure for securely locking the cover into discrete positions of travel along the sliding means in which the spring loaded pins have been retracted, allowing the cover to translate along the sliding means.

Referring now to FIGS. 9*a* and 9*b*, a rear view of an alternate embodiment of the secondary navigation station is shown. In this embodiment, spring loaded pin assemblies 401 are attached to seat base frame 400. Spring loaded pin assemblies 401 may comprise spring loaded pins 403 which may be captured in holes in starboard slide rail 103 and port slide rail 111, and which may be connected together via an attachment means which may be, for instance, a cable such as a steel stranded or other cable which may have crimped ends 404 such that a user of the invention standing underneath the secondary navigation station is able to reach up and grasp cable 402. When spring loaded pins 403 are captured in holes in starboard slide rail 103 and port slide rail 111, cover 102, which may comprise a seat and cover mounting plate 102*a*, is prohibited from translating on the sliding means and is in a "locked" status. When a user grasps cable 402 and pulls downward, spring loaded pins 403 are caused to retract into spring loaded pin assemblies 401, thus disengaging spring loaded pins from holes in starboard slide rail 103 and port slide rail 111, allowing cover 102 to translate along the sliding means to any position desired by the user and placing cover 102 in a "free" status, meaning it is free to translate along the sliding means as motivated by the user. Any number of holes in starboard slide rail 103 and in port slide rail 102 may be utilized to define discrete points of capture of cover 102 at any point of travel along the sliding means as may be desired by the user. In one alternate embodiment of the invention, three holes in starboard slide rail 103 and three holes in port slide rail 111 are utilized to define three discrete points of capture of cover 102 along the sliding means. In this embodiment of the invention, one hole in each slide rail is located so as to capture cover 102 at the forward limit of travel of the sliding means; one hole in each slide rail is located so as to capture cover 102 at an intermediate position between the forward limit of travel of the sliding means and the aft limit of travel of the sliding means such that cover 102 is located at a position comfortable for a user to sit on cover 102 and operate the watercraft using the controls located on the secondary navigation station controls console mounted on secondary navigation station upper surface 113; and one hole in each slide rail is located so as to capture cover 102 at the aft limit of travel of the sliding means. This use of the secondary navigation station of the invention is depicted further in FIG. 4*b*. A seat base frame 400 may be attached to the bottom surface of each side of cover mounting plate 102*a* as depicted in FIG. 9, one seat base frame 400 on the port side and one seat base frame 400 on the starboard side of the bottom surface of either cover 102 if no cover mounting plate is used, or on the bottom surface of cover mounting plate 102*a* as shown. Still referring to FIG. 9, support structure horizontal tubing 157, support structure aft tubing 152, support structure forward tubing 153, back rest support 105 and secondary navigation station structure 112 are depicted for reference.

Referring specifically to FIG. 9*a*, cover 102 is shown in a locked status wherein spring loaded pins 403 are captured in holes in starboard slide rail 103 and port slide rail 111. FIG. 9*b* depicts cover 102 in a free status wherein spring loaded pins 403 are caused to retract into spring loaded pin assemblies 401 by the pulling of cable 402 in the direction of arrow E, thus causing spring loaded pins to translate in the direction indicated by arrow F and disengaging spring loaded pins from holes in starboard slide rail 103 and port slide rail 111.

Further, the secondary navigation station of the invention may comprise a latch of any type known in the art, which may be a locking latch, to securely close cover 102 to prevent theft of items for those instances in which the underneath structure upon which the improved secondary navigation station of the invention is also enclosed.

Attaching hardware, such as mounting bolts, which are depicted in the various figures of the drawings, are shown as exemplary methods of attachment. It is to be understood that well-known alternate means of attachment such as, for example, rivets and chemical bonding using adhesives or multipart epoxies and the like, are well-known alternative means for attaching structural and other elements together. Therefore, it is to be understood that were ever attaching hardware such as mounting bolts are depicted in the figures of the drawings, such well-known alternate means of attachment are included within the scope of the claims as equivalents thereof.

Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

What is claimed is:

1. A secondary navigation station for a boat, comprising:

a secondary navigation station structure having an outer perimeter, an upper surface, a port side, a starboard side, a lower surface and an opening, said opening having a perimeter and passing through said structure from said structure upper surface to said structure lower surface;

said secondary navigation station structure being securely affixed to a boat in an elevated position over a lower primary console via a support structure;

a control console comprising engine throttle controls and a steering element, said control console disposed on and attached to said upper surface of said secondary navigation station structure;

a cover slidingly engaged with said upper surface by sliding means;

wherein said sliding means allows for translation of said cover in both a forward and aft direction;

wherein said cover perimeter covers said opening perimeter at at least one point of translation of said cover on said sliding means; and a standing surface located directly below said opening and above said lower primary console to provide a surface for an individual to stand in an elevated position above the lower primary console while surrounded by the opening and in a position to operate said control console disposed on and attached to said upper surface of said secondary navigation station structure.

2. The secondary navigation station of claim 1, wherein said translation of said cover is further defined as having a fully closed position at a forward limit of said travel, an open position at said aft limit of said travel, and a partially open position defined as a position of travel between said closed position and said open position, and wherein said cover perimeter completely occludes said opening when said cover is disposed at said closed position.

3. The secondary navigation station of claim 2, wherein said cover is further defined as a seat.

4. The secondary navigation station of claim 2, wherein said cover further comprises a perimeter, and wherein said cover perimeter is greater than said opening perimeter.

5. The secondary navigation station of claim 4, wherein said cover is further defined as a seat.

6. The secondary navigation station of claim 1, wherein said cover is further defined as a seat.

7. A secondary navigation station for a boat, comprising:

a secondary navigation station structure having an outer perimeter, an upper surface, a port side, a starboard side, a lower surface and an opening, said opening having a perimeter and passing through said structure from said structure upper surface to said structure lower surface;

said secondary navigation station structure being securely affixed to a boat in an elevated position over a lower primary console via a support structure;

a control console comprising engine throttle controls and a steering element, said control console disposed on and attached to said upper surface of said secondary navigation station structure; a cover slidingly engaged with said upper surface by sliding means;

wherein said sliding means allows for translation of said cover in both a forward and aft direction;

said cover is further defined as a seat;

wherein said cover perimeter covers said opening perimeter at at least one point of translation of said cover on said sliding means; and a standing surface located directly below said opening and above said lower primary console to provide a surface for an individual to stand in an elevated position above the lower primary console while surrounded by the opening and in a position to operate said control console disposed on and attached to said upper surface of said secondary navigation station structure.

8. The secondary navigation station of claim 7, wherein said translation of said cover is further defined as having a fully closed position at a forward limit of said travel, an open position at said aft limit of said travel, and a partially open position defined as a position of travel between said closed position and said open position, and wherein said cover perimeter completely occludes said opening when said cover is disposed at said closed position.

9. The secondary navigation station of claim 7, wherein said cover further comprises a perimeter, and wherein said cover perimeter is greater than said opening perimeter.

10. A secondary navigation station for a boat, comprising:

a secondary navigation station structure having an outer perimeter, an upper surface, a port side, a starboard side, a lower surface and an opening, said opening having a perimeter and passing through said structure from said structure upper surface to said structure lower surface;

said secondary navigation station structure being securely affixed to a boat in an elevated position over a lower primary console via a support structure;

a control console comprising engine throttle controls and a steering element, said control console disposed on and attached to said upper surface of said secondary navigation station structure; a cover slidingly engaged with said upper surface by sliding means;

wherein said sliding means allows for translation of said cover in both a forward and aft direction;

said cover is further defined as a seat;

wherein said cover perimeter covers said opening perimeter at at least one point of translation of said cover on said sliding means; and a standing surface located directly below said opening and above said lower primary console to provide a surface for an individual to stand in an elevated position above the lower primary console while surrounded by the opening and in a position to operate said control console disposed on and attached to said upper surface of said secondary navigation station structure.

11. The secondary navigation station of claim 10, wherein said translation of said cover is further defined as having a fully closed position at a forward limit of said travel, an open position at said aft limit of said travel, and a partially open position defined as a position of travel between said closed position and said open position, and wherein said cover perimeter completely occludes said opening when said cover is disposed at said closed position.

12. The secondary navigation station of claim 10, wherein said cover further comprises a perimeter, and wherein said cover perimeter is greater than said opening perimeter.

* * * * *